US006474002B2

(12) United States Patent
Chen

(10) Patent No.: US 6,474,002 B2
(45) Date of Patent: Nov. 5, 2002

(54) WATERPROOF SHOE HAVING A WATERPROOF BUT VAPOR-PERMEABLE LINING SLEEVE

(76) Inventor: Eddie Chen, 5F, No. 201, Sec. 1, Taichung-Kang Rd., Taichung City (TW)

( * ) Notice: Subject to any disclaimer, the term of this patent is extended or adjusted under 35 U.S.C. 154(b) by 0 days.

(21) Appl. No.: 09/761,891

(22) Filed: Jan. 17, 2001

(65) Prior Publication Data

US 2001/0049889 A1 Dec. 13, 2001

Related U.S. Application Data

(63) Continuation-in-part of application No. 09/591,201, filed on Jun. 9, 2000.

(51) Int. Cl.[7] ..... A43B 23/07
(52) U.S. Cl. ..... 36/55; 36/14
(58) Field of Search ..... 36/55, 14, 4

(56) References Cited

U.S. PATENT DOCUMENTS

| | | | | |
|---|---|---|---|---|
| 32,575 A | | 6/1861 | Meyer | |
| 967,064 A | | 8/1910 | Savage | |
| 1,725,749 A | | 8/1929 | Blair | |
| 2,200,333 A | | 5/1940 | Herzog et al. | 36/4 |
| 2,306,306 A | | 12/1942 | Ferrettie | 36/4 |
| 2,428,626 A | | 10/1947 | Jaeger et al. | 36/4 |
| 3,668,056 A | | 6/1972 | Hayes, Jr. | 161/159 |
| 4,599,810 A | | 7/1986 | Sacre | 36/55 |
| 4,707,874 A | | 11/1987 | Champagne | 12/142 E |
| 5,526,584 A | | 6/1996 | Bleimhofer et al. | 36/10 |
| 5,678,326 A | | 10/1997 | Pavelescu | 36/14 |
| 5,732,479 A | * | 3/1998 | Pavelescu | 36/12 |
| 5,732,480 A | * | 3/1998 | Notzold | 36/14 |
| 5,778,473 A | | 7/1998 | Chen | 12/142 T |
| 6,065,227 A | * | 5/2000 | Chen | 12/142 A |
| 6,088,935 A | * | 7/2000 | Pavelescu et al. | 36/14 |
| 6,115,940 A | * | 9/2000 | Chen | 12/142 E |

FOREIGN PATENT DOCUMENTS

| | | |
|---|---|---|
| DE | 607267 | 12/1934 |
| FR | 2526668 | 11/1983 |
| NO | 52613 | 5/1933 |

* cited by examiner

*Primary Examiner*—Ted Kavanaugh
(74) *Attorney, Agent, or Firm*—Fish & Richardson P.C.

(57) ABSTRACT

A waterproof shoe includes an insole, an upper having a bottom open end secured to an insole, and a waterproof but vapor pervious lining sleeve disposed inside the upper. The lining sleeve includes a top open end connected to the top open end of the upper, and a bottom open end extending along an inner surface of the upper and ending at a distance from and above the bottom end of the upper. An adhesive or a waterproof adhesive tape is attached to and bonds together the bottom open end of the lining sleeve and the upper.

13 Claims, 8 Drawing Sheets

WATERPROOF SHOE HAVING A WATERPROOF BUT VAPOR-PERMEABLE LINING SLEEVE

CROSS-REFERENCE TO RELATED APPLICATION

This application is a continuation-in-part application of U.S. patent application Ser. No. 09/591,201 filed on Jun. 9, 2000 still pending.

BACKGROUND OF THE INVENTION

1. Field of the Invention

The invention relates to a waterproof shoe, more particularly to a waterproof shoe with an inner liner which is made of a water impervious but vapor-permeable material disposed inside an upper and which has a bottom open end bonded to the upper.

2. Description of the Related Art

Conventional waterproof shoes generally include an outer shell made of a waterproofing material which is impervious to both air and vapor. Such waterproof shoes tend to cause discomfort to the wearer, as ventilation of perspiration vapors gathered around the wearer's feet is not permitted. Improvements available in the art for coping with such perspiration problems include the use of a non-waterproof material, such as leather or fabric, for the outer shell of an upper and the use of a sock-like liner, which is made of a material or laminate impervious to water but pervious to perspiration vapor, as a protection part for the foot against water intrusion. In particular, shoe constructions with such an improvement generally include a sock-like liner which has a top open end secured to the top open end of an upper, and a bottom wall seated on and bonded adhesively to a midsole which is secured to the bottom end of the upper. A disadvantage found in such constructions is that water can seep into the interior of the shoe through the seams of the shoe and can be trapped in the space between the upper and the sock-like liner.

Attempts have been made in order to alleviate the aforesaid water seeping problems by improving the waterproofing characteristics of the waterproof breathable shoes. U.S. Pat. No. 5,678,326 suggests an improved shoe construction which comprises an outer shell connected to an insole, a waterproof, water-vapor permeable shoe insert disposed inside the outer shell, and a lining provided inside the shoe insert. Both of the lining and the shoe insert have their bottom walls extending between an outsole and an insole, and are secured to the bottom portion of the upper and to the outsole and insole by using several layers of adhesive.

As described herein above, the prior art addressed the aforesaid water seeping problem by focusing on improvements on the waterproofing characteristics of the shoes. The technical measures taken in the art to enhance the waterproofing characteristics, however, tend to reduce the ventilating characteristics and vapor permeability of shoes.

U.S. Pat. No. 6,065,227 discloses a waterproof boot construction designed to provide a drain outlet for the water invading the boot. The boot construction as disclosed therein comprises an outer shell having an upper of non-waterproof material, and a lower of waterproof material and utilizes a waterproof, water-vapor permeable inner lining sleeve to line the upper. The bottom ends of the upper and the lining sleeve are stitched to a top end of the lower, and a water-tight seal is provided inside the lining sleeve and the lower so that the water seeping through the stitched seam into the space between the lining sleeve and the upper is prevented from invading the interior of the lining sleeve and the lower and is diverted to the stitched seam for drainage. The drain outlet formed as such is located along the stitched joint of the overlapping parts of the upper and the lower of the boot.

U.S. Pat. No. 4,599,810 discloses stitchdown shoes which incorporate waterproof, vapor permeable sock-like liners and which provide good ventilating property. In the construction of these shoes, although a stitchdown formed at the joint of a midsole and an upper permits ventilation, since a padding, which is typically made of a fibrous or foamed material, is disposed between the inner surface of the upper and the sock-like liner, the water penetrating through the stitchdown can be retained in the padding due to the water-wicking property of the padding. The wet padding not only adds weight to the shoe but also reduces the warmness of the shoe. On the other hand, the sock-like liner used in this shoe construction has a bottom wall which is seated on a midsole and is secured adhesively thereto. The need to provide the liner with the bottom wall complicates the process of making the shoe and increases the consumption of expensive waterproof, vapor permeable material. The procedure for securing adhesively the bottom wall of the liner to the midsole is also cumbersome and time-consuming.

SUMMARY OF THE INVENTION

An object of the present invention is to provide a waterproof shoe which permits the wearer's feet to breathe.

Another object of the present invention is to provide a waterproof breathable shoe which can be produced via a less complicated process with reduced consumption of expensive waterproof breathable material.

According to the present invention, a waterproof shoe includes an insole, an upper having a top open end and a bottom open end secured to the insole, and a lining sleeve disposed inside the upper. The lining sleeve has a top open end connected to the top open end of the upper, and a bottom open end extending along an inner surface of the upper and ending at a distance from and above the bottom open end of the upper. The lining sleeve is made of a material, which is impervious to water but is pervious to perspiration vapor. Waterproof means is adhesively attached to and bonds together the upper and the lining sleeve.

BRIEF DESCRIPTION OF THE DRAWINGS

Other features and advantages of the present invention will become apparent in the following:detailed description of the preferred embodiments with reference to the accompanying drawings, of which.

DETAILED DESCRIPTION OF THE PREFERRED EMBODIMENTS

Figure 1:
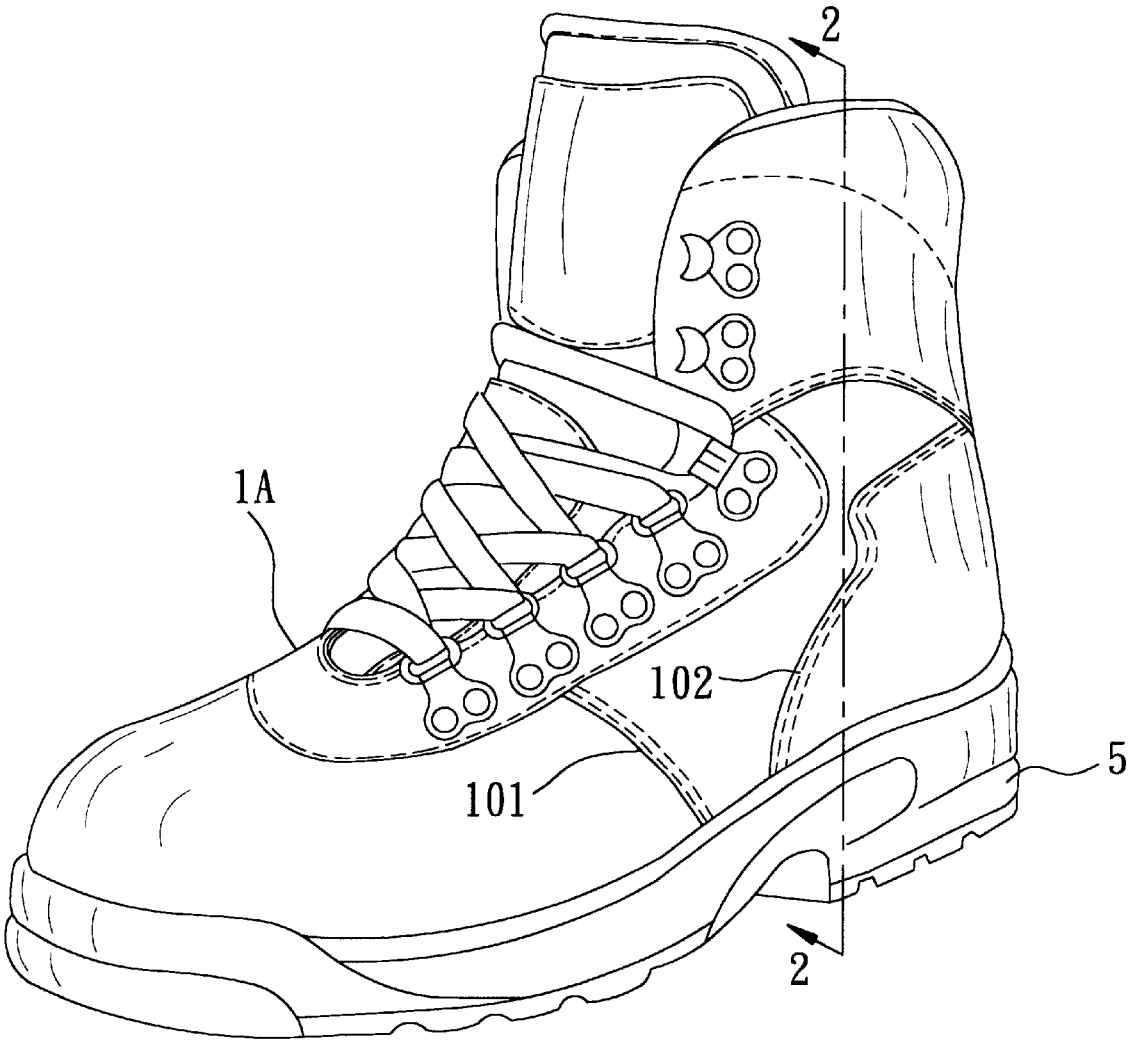
FIG. 1 is a perspective view of a shoe embodying the present invention.
Figure 2:
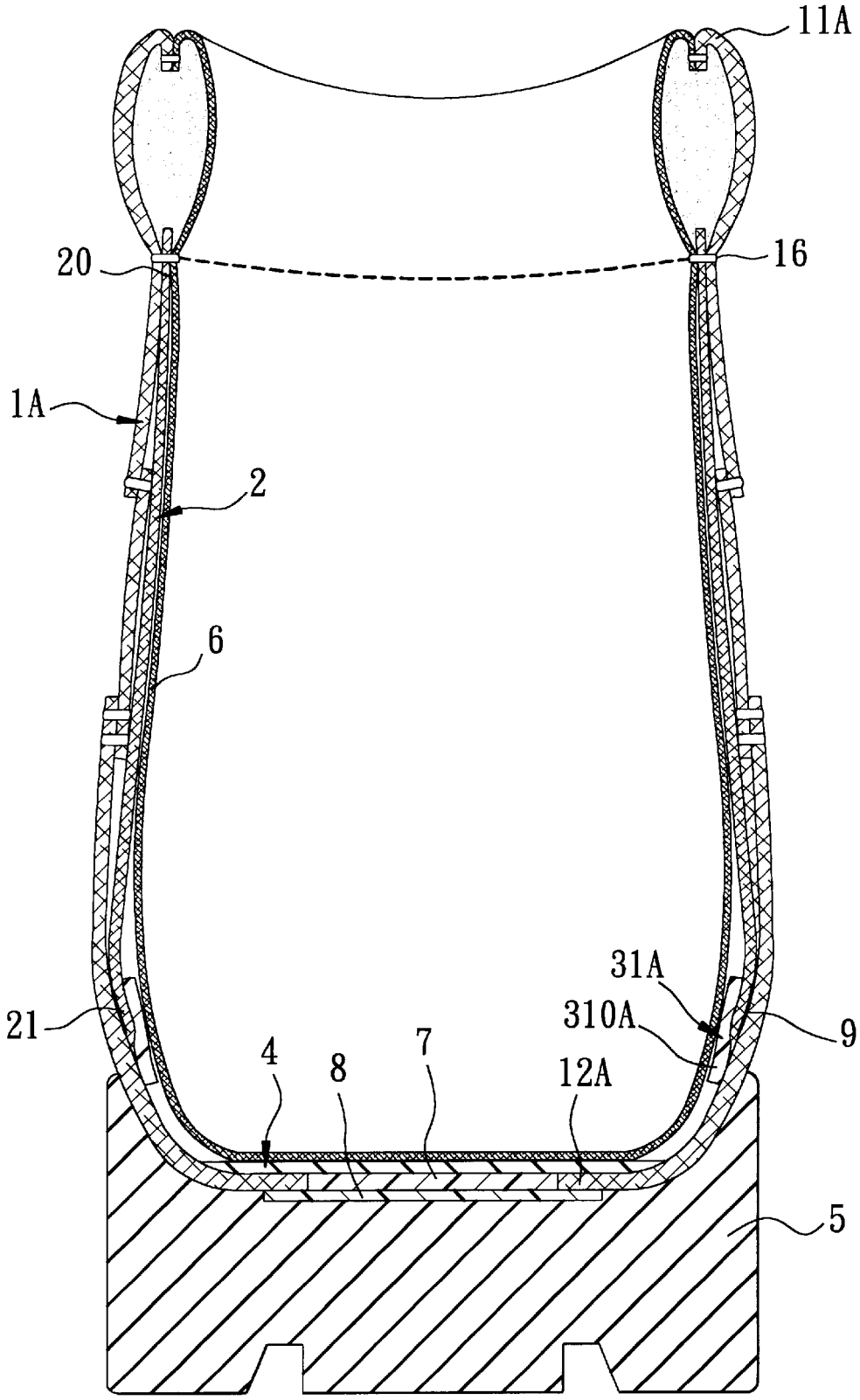
FIG. 2 is a sectional view taken along line 2—2 of FIG. 1.

Referring to FIGS. 1 and 2, a preferred embodiment of a shoe according to the present invention is shown to include an upper 1A which has a bottom open end lasted to form an inwardly turned bottom flange 12A. A lining sleeve 2 is disposed inside the upper 1A, and a sock-like inner lining 6 is provided inside the lining sleeve 2. The lining sleeve 2 has a top open end 20 secured to the upper 1A and the inner lining 6 along a stitched seam 16 below and adjacent to the top open end 11A of the upper 1A. The top open end 11A of the upper 1A is stitched to the top end of the inner lining 6. Alternatively, the top open end 20 of the lining sleeve 2 may be prolonged so as to extend to and connect with the top open end 11A of the upper 1A via stitching.

The lining sleeve 2 is made of a typical material which is impervious to water but pervious to perspiration vapors. The lining sleeve 2 has a configuration substantially conforming to the interior of the upper 1A but has a bottom open end 21 which ends at a distance from and above the bottom flange 12A of the upper 1A. The bottom open end 21 of the lining sleeve 2 is bonded adhesively to the inner surface of the upper 1A, thus forming a seam 9 therebetween.

A waterproof tape 31A is bonded adhesively to the inner surface of the lining sleeve 2 along the bottom open end 21 of the lining sleeve 2 and is further bonded adhesively to the inner surface of the upper 1A adjacent to the bottom open end 21. The bottom end 310A of the waterproof tape 31A does not extend to the bottom flange 12A of the upper 1A. As the seam 9 is watertight, the water invading the space between the lining sleeve 2 and the upper 1A can be prevented from flowing downward to the bottom end of the upper and drained out through stitch seams of the upper 1A, such as those designated at 101, 102 in FIG. 1. In addition, perforations (not shown) may be provided in the upper 1A above the seam 9 for drainage of the invading water.

The bottom flange 12A of the upper 1A is secured to an insole 4 and an outsole 5 by means of a watertight soling process. A filler 7 is inserted into an opening confined by the bottom flange 12A of the upper 1A. A waterproof cover 8 is provided beneath the filler 7.

Figure 3:
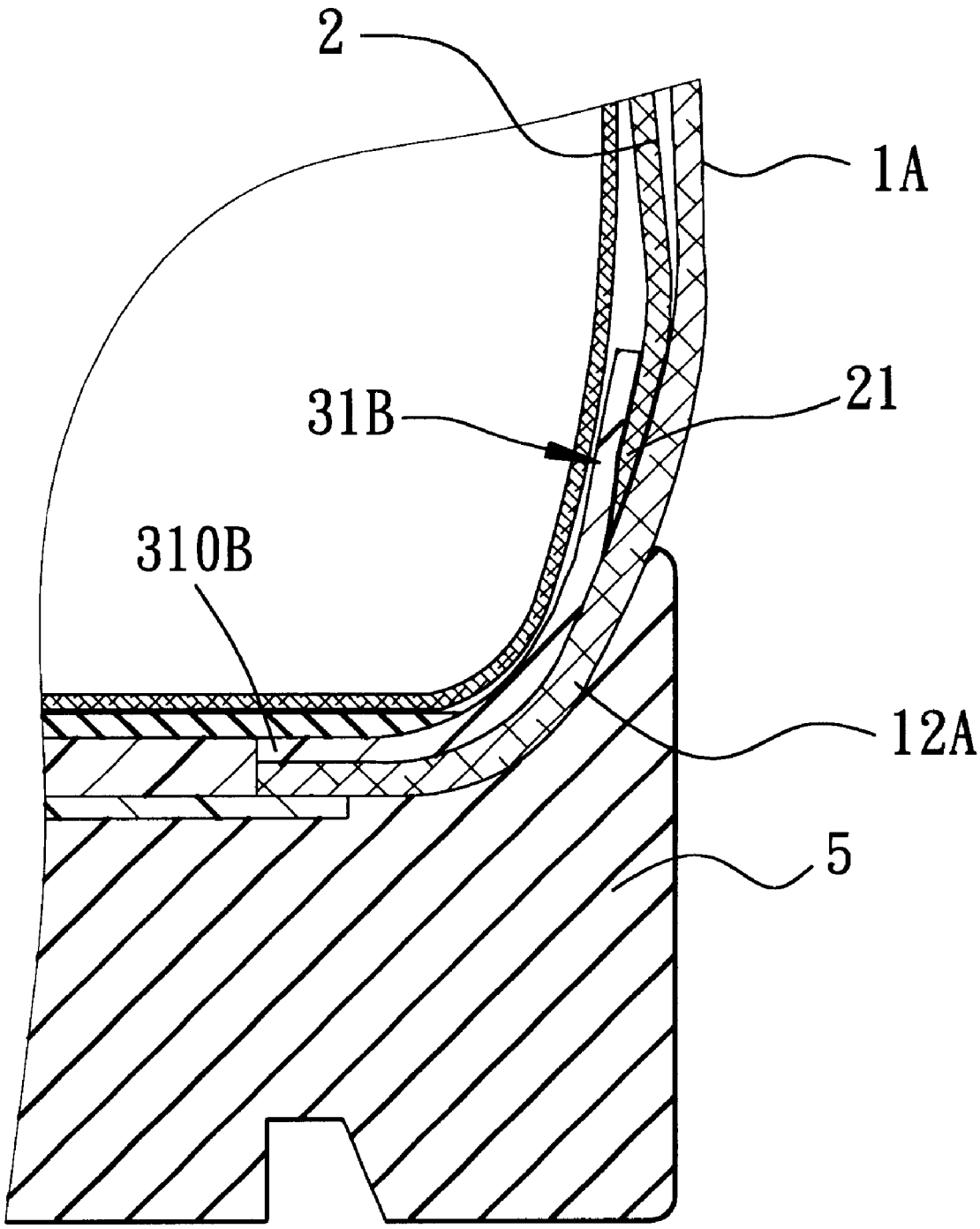
FIG. 3 is the same view as FIG. 2 but with a portion thereof being removed and with a waterproof tape extending to the bottom end of the upper.

Although the waterproof tape 31A as shown does not extend to the bottom flange 12A of the upper 1A, it is not limited thereto in the present invention. A waterproof means 31B which has a bottom end 310B extends to the bottom flange 12A of the upper 1A, as shown in FIG. 3, may be used in place of the waterproof tape 31A. The top end of the waterproof means 31B is connected to the bottom open end 21 of the lining sleeve 2. This waterproof means 31B serves as a waterproof liner to line the inner surface of the upper 1A beneath the bottom open end 21 of the lining sleeve 2.

Figure 4:
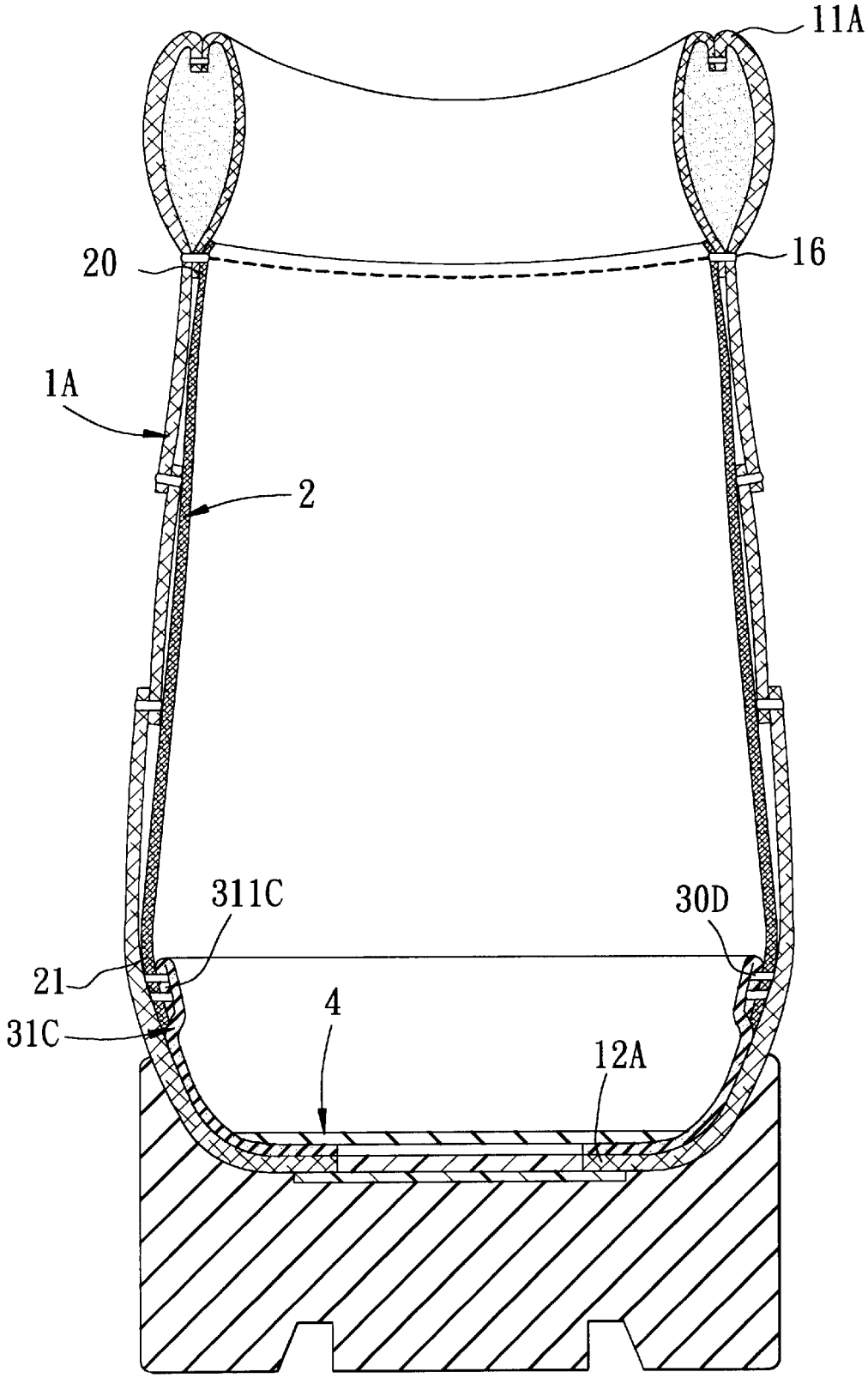
FIG. 4 is the same view as FIG. 2 but with the waterproof means being provided with a top folded portion.

Referring to FIG. 4, there is another embodiment which has substantially the same construction as the embodiment of FIG. 2 except that a waterproof means 31C has, at the top end thereof, a folded top portion 311C that is folded outward and downward. The bottom open end 21 of the lining sleeve 2 is bonded adhesively to the inner surface of the upper 1A. The folded top portion 311C is in contact with the inner surface of the bottom open end 21 of the lining sleeve 2 and is stitched to the bottom open end 21 of the lining sleeve 2. During fabrication, the waterproof means 31C is first stitched to the bottom open end 21 of the lining sleeve 2 and is then folded back to overlie a seam 30D. The bottom end of the waterproof means 31C extends to the bottom open end 12A of the upper 1A. The outer surface of the waterproof means 31C is bonded adhesively to the inner surface of the upper 1A. This waterproof means 31C serves as a waterproof liner that lines the inner surface of the upper 1A beneath the lining sleeve 2. No additional inner liner is provided in this embodiment.

Figure 5:
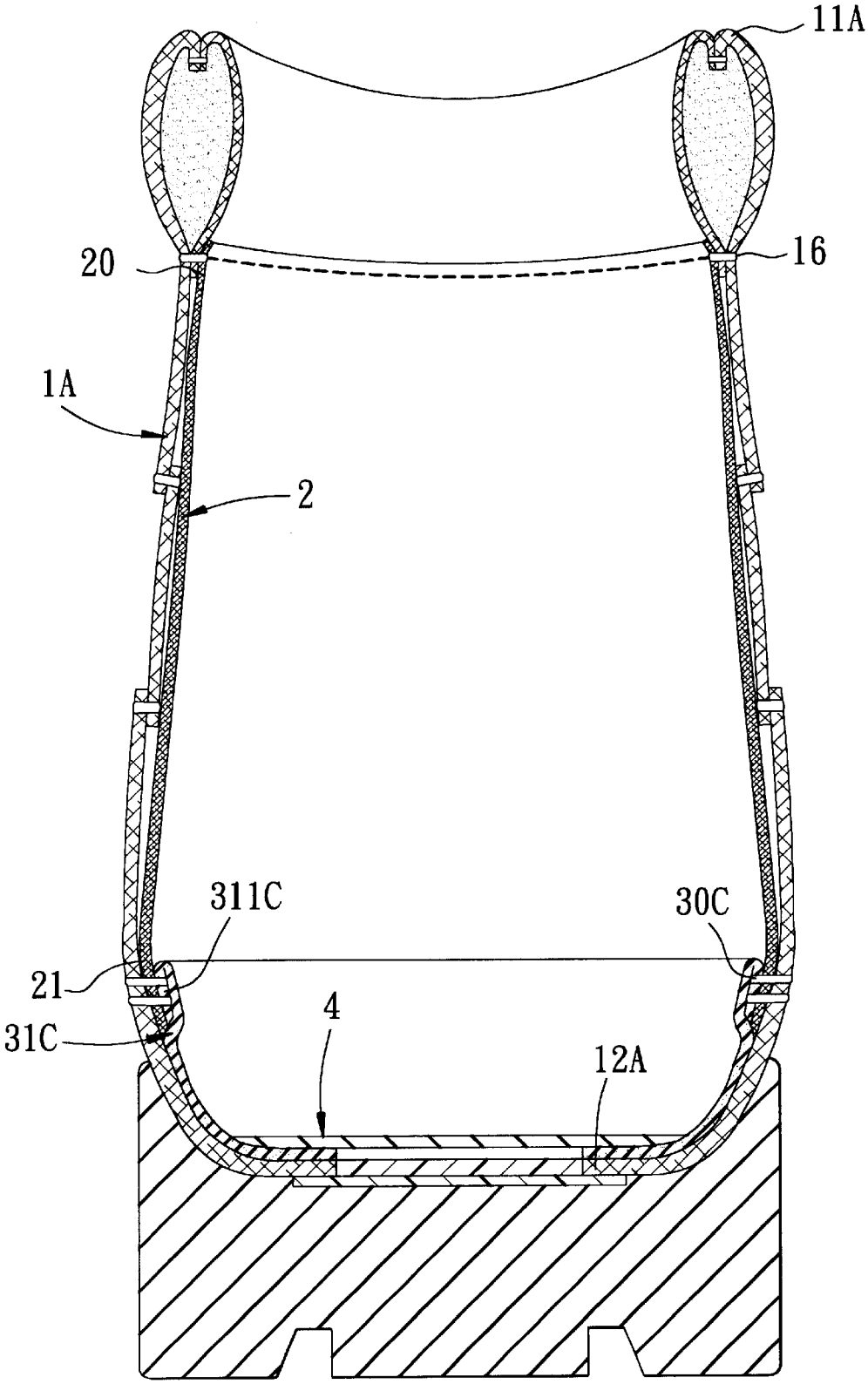
FIG. 5 is a sectional view showing another embodiment of the present invention.

Referring to FIG. 5, a waterproof shoe shown therein has a construction substantially similar to that shown in FIG. 4 except that the waterproof means 31C is stitched to the upper 1 together with the bottom open end 21 of the lining sleeve 2 along a seam 30C.

Figure 6:
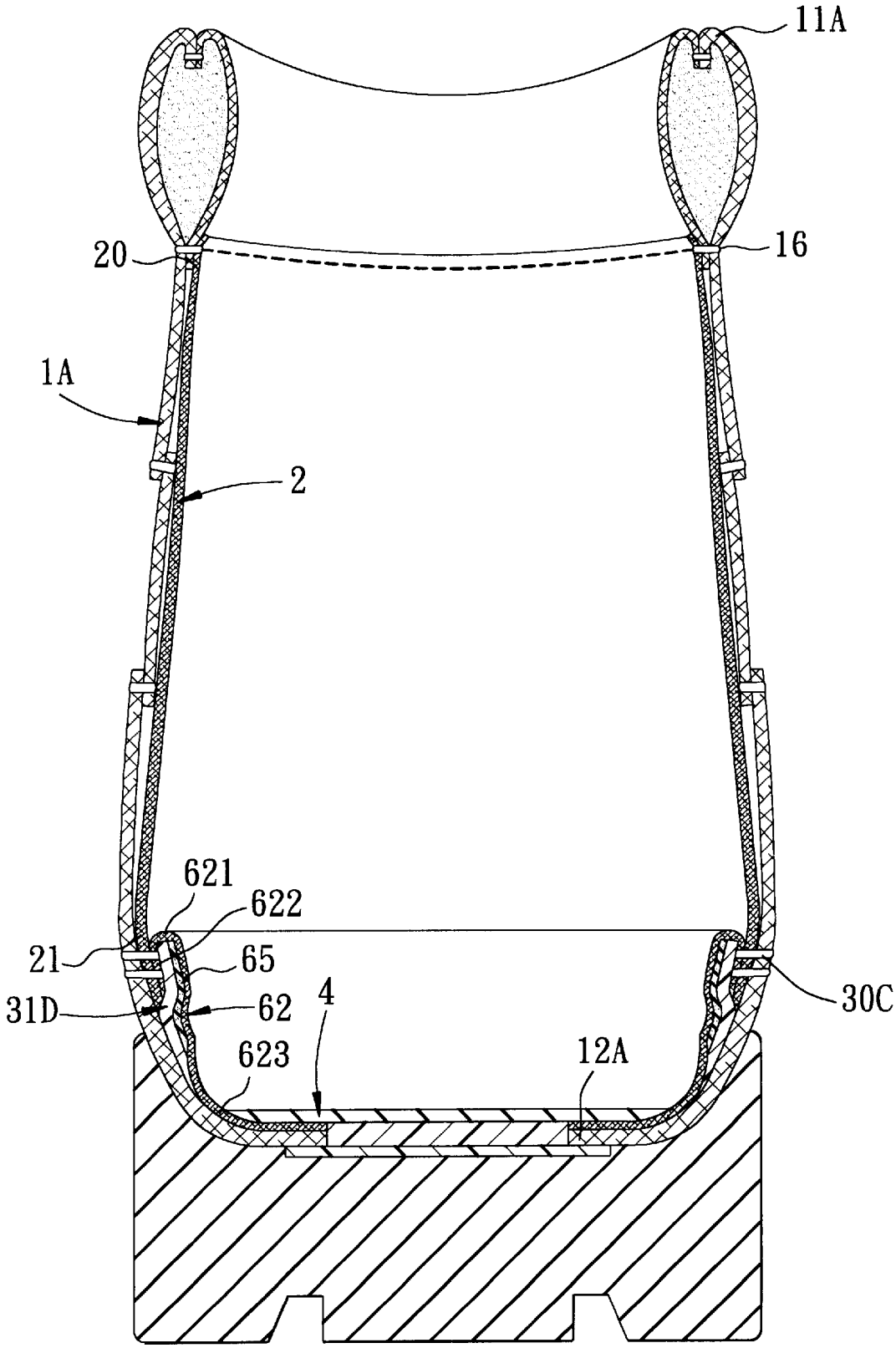
FIG. 6 is a sectional view showing still another embodiment of the present invention.

Referring to FIG. 6, a waterproof shoe shown therein additionally includes a bottom liner 62 which is connected to the bottom open end 21 of the lining sleeve 2 and which is stitched to the upper 1A along a seam 30C, as compared to the embodiment of FIG. 2. The. bottom liner 62 is preferably made of a soft lining material such as a fabric, a soft plastic material or leather. The bottom liner 62 includes a bottom end 623 extending to the bottom open end 12A of the upper 1A and bonded adhesively to the same, a top folded end 621 extending adjacent to the bottom open end 21 of the lining sleeve 2, and a connection portion 622 extending outwardly and downwardly from the top folded end 621. The connection portion 622 is stitched to the bottom open end 21 of the lining sleeve 2 and the upper 1A along the seam 30C. A waterproof tape 31D extends into the top folded end 621 and is bonded adhesively to the connection portion 622 and the inner surface of the upper to seal the seam 30C. A foamed material 65 is optionally disposed between the waterproof tape 31D and the bottom liner 62 to provide enhanced softness and cushioning effects.

Figure 7:
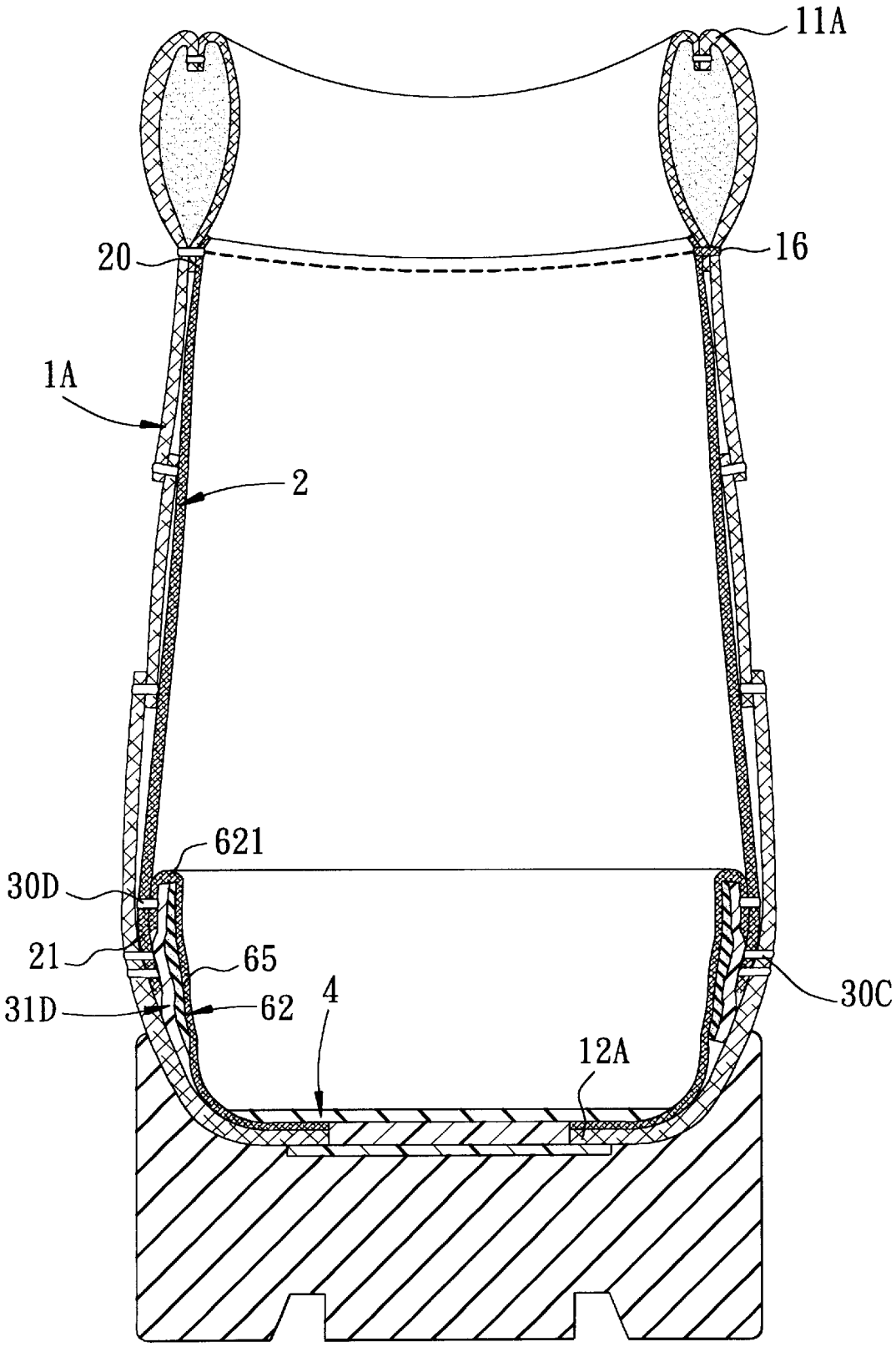
FIG. 7 is a sectional view showing yet another embodiment of the present invention.

Referring to FIG. 7, a waterproof shoe shown therein differs from that of FIG. 6 in that the connection portion 622 at the top folded end 621 of the bottom liner 62 is stitched to the bottom open end 21 of the lining sleeve 2 along a seam 30D, rather than the seam 30C. Only the bottom open end 21 of the lining sleeve 2 is stitched to the upper 1A along the seam 30C.

Figure 8:
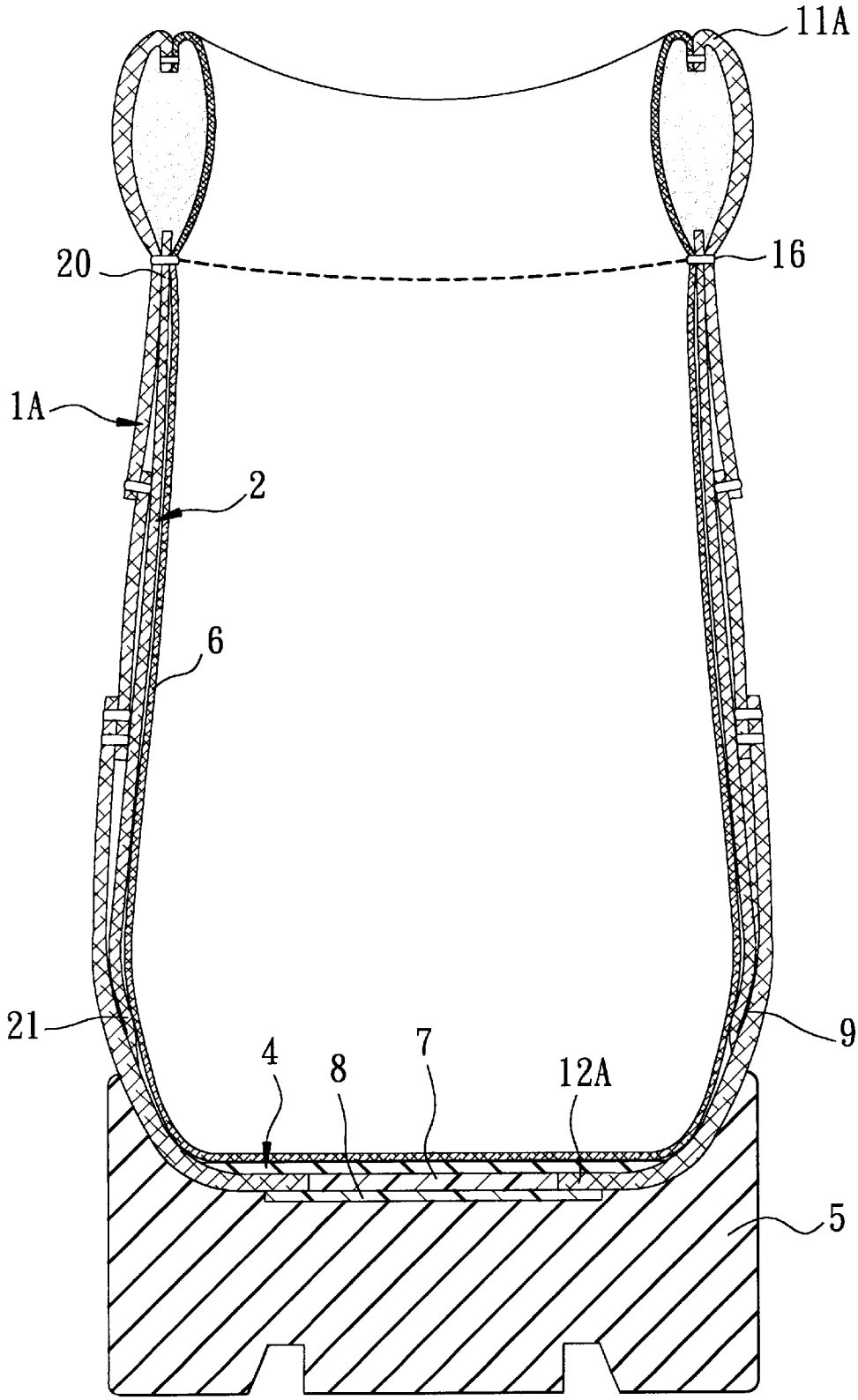
FIG. 8 is a sectional view showing yet another embodiment of the present invention.

Referring to FIG. 8, a waterproof shoe shown therein differs from that of FIG. 2 in that the waterproof means thereof merely includes an adhesive disposed between the bottom open end 21 of the lining sleeve 2 and the inner surface of the upper 1A so as to bond together the same. The waterproof tape 31A shown in FIG. 2 is not provided in this embodiment.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A waterproof shoe comprising:

an insole;

an upper including a top open end, and a bottom open end secured to said insole;

a lining sleeve disposed inside said upper, said lining sleeve having a top open end connected to said top open end of said upper, and a bottom open end extending along an inner surface of said upper and ending at a distance from and above a surface of said insole, said lining sleeve being made of a material which is impervious to water but is pervious to perspiration vapor; and a waterproof member attached adhesively to and bonding together said bottom open end of said lining sleeve and said upper, said bottom open end of said lining sleeve being attached directly to said upper above the surface of said insole.

2. The waterproof shoe as claimed in claim 1, wherein said waterproof member includes a waterproof adhesive attached to said upper and said lining sleeve between said upper and said bottom open end of said lining sleeve.

3. The waterproof shoe as claimed in claim 1, wherein said waterproof member includes a waterproof tape adhesively attached to said inner surface of said upper and an inner surface of said bottom open end of said lining sleeve.

4. The waterproof shoe as claimed in claim 3, wherein said waterproof tape has a top end extending along said inner surface of said bottom open end of said lining sleeve, and a bottom open end extending downward to said bottom open end of said upper.

5. The waterproof shoe as claimed in claim 4, wherein said top end of said waterproof tape has a top folded portion which extends outward and downward from said top end of said waterproof tape and which is stitched to said bottom open end of said lining sleeve.

6. The waterproof shoe as claimed in claim 1, wherein said waterproof member has a waterproof tape which has a top end extending along the inner surface of said bottom open end of said lining sleeve, a top folded portion which extends outward and downward from said top end of said waterproof member, and a bottom end extending downward to said bottom open end of said upper, said top folded portion being stitched to said bottom open end of said lining sleeve and said upper.

7. The waterproof shoe as claimed in claim 1, further comprising a bottom liner which has a top end connected to said bottom open end of said lining sleeve, and a bottom end extending to and connected to said bottom open end of said upper.

8. The waterproof shoe as claimed in claim 7, wherein said top end of said bottom liner has a top folded end, and a connection portion extending outward and downward from said top folded end of said bottom liner and stitched to said bottom open end of said lining sleeve.

9. The waterproof shoe as claimed in claim 8, wherein said connection portion, together with said bottom open end of said lining sleeve, is stitched to said upper.

10. The waterproof shoe as claimed in claim 9, wherein said waterproof means includes a waterproof tape which extends into said top folded end of said bottom liner and is bonded adhesively to the inner surface of said connection portion and the inner surface of said upper.

11. The waterproof shoe as claimed in claim 8, wherein said connection portion is stitched to said bottom open end of said lining sleeve independently of said upper.

12. The waterproof shoe as claimed in claim 11, wherein said waterproof tape extends into said top folded end of said bottom liner and is bonded adhesively to the inner surface of said connection portion and the inner surface of said upper.

13. A waterproof shoe comprising:

a sole;

an upper including a top open end, and a bottom open end mounted on said sole;

a lining sleeve disposed inside said upper, said lining sleeve having a top open end connected to said top open end of said upper, and a bottom open end extending along an inner surface of said upper and ending at a distance from and above a surface of said sole extending within said upper, said lining sleeve being made of a material which is impervious to water but is pervious to perspiration vapor; and a waterproof member attached adhesively to and bonding together said bottom open end of said lining sleeve and said upper, said bottom open end of said lining sleeve being attached directly to said upper above said surface of said sole extending within said upper.

* * * * *